US006367709B2

(12) United States Patent
Heinz et al.

(10) Patent No.: US 6,367,709 B2
(45) **Date of Patent: *Apr. 9, 2002**

(54) FUEL INJECTION VALVE

(75) Inventors: Rudolf Heinz, Renningen; Roger Potschin, Brackenheim; Friedrich Boecking, Stuttgart, all of (DE)

(73) Assignee: Robert Bosch GmbH, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/254,049

(22) PCT Filed: Mar. 14, 1998

(86) PCT No.: PCT/DE98/00764

§ 371 Date: Mar. 1, 1999

§ 102(e) Date: Mar. 1, 1999

(87) PCT Pub. No.: WO99/01660

PCT Pub. Date: Jan. 14, 1999

(30) Foreign Application Priority Data

Jul. 1, 1997 (DE) ..... 197 27 896

(51) Int. Cl.[7] ..... F02M 41/16

(52) U.S. Cl. ..... 239/96; 239/533.3

(58) Field of Search ..... 239/88, 91, 94, 239/96, 95, 533.3

(56) References Cited

U.S. PATENT DOCUMENTS 3,409,226 A * 11/1968 Steiger
3,633,823 A * 1/1972 Steiger
5,671,715 A * 9/1997 Tsuzuki

FOREIGN PATENT DOCUMENTS

JP 61-1859 A * 1/1986

* cited by examiner

*Primary Examiner*—David A. Scherbel
*Assistant Examiner*—Christopher S. Kim
(74) *Attorney, Agent, or Firm*—Ronald E. Greigg

(57) ABSTRACT

A fuel injection valve having a valve member that is controlled by the pressure in a control pressure chamber and whose opening motion is influenced by way of a compensation pressure face of the valve member. This compensation pressure face adjoins a hydraulic chamber whose pressure is controlled with the aid of a piston which reduces the hydraulic initial stress of the hydraulic chamber, and keeps the fuel at an essentially constant value, and can compensate for volume changes of the hydraulic chamber by moving in opposition to a reference pressure.

19 Claims, 1 Drawing Sheet

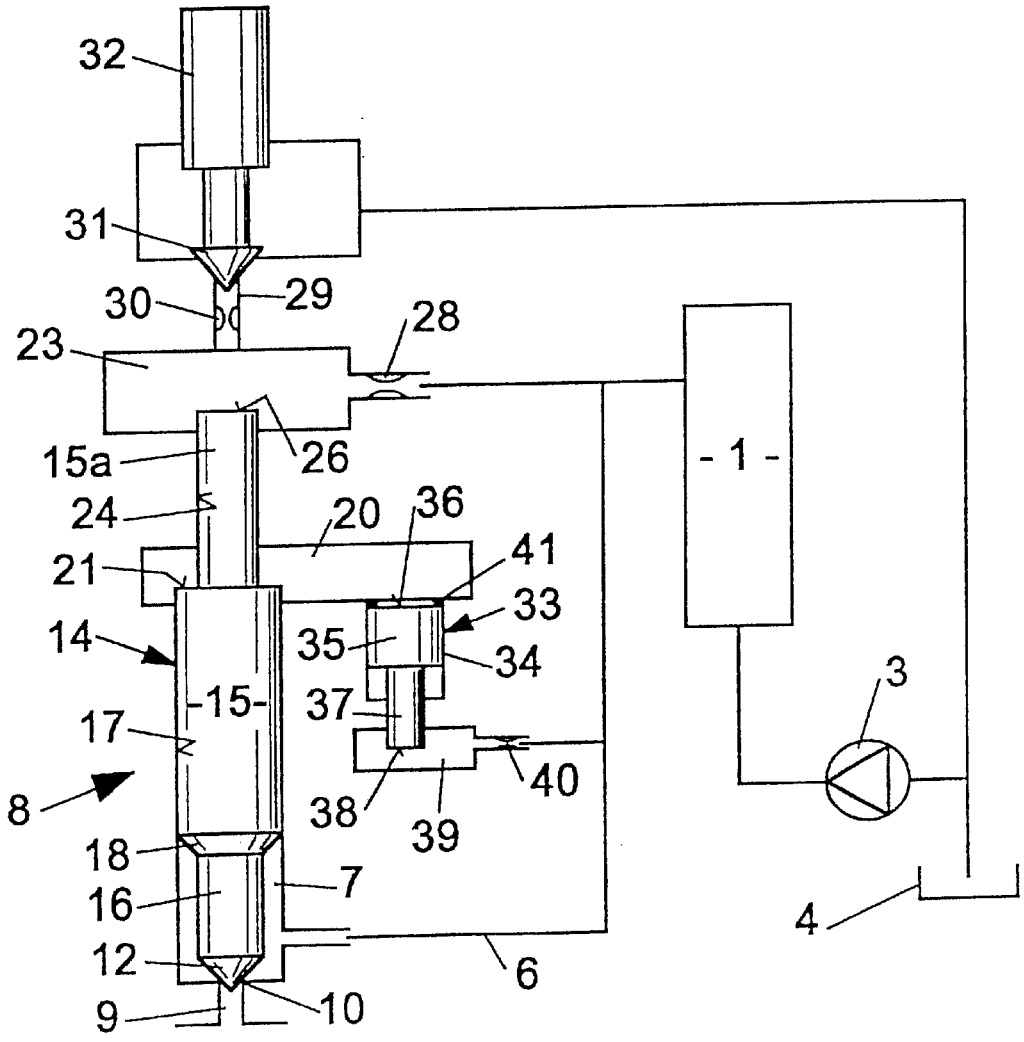
32
31
30
29
28
23
26
15a
24
20
36
41
21
33
14
35
34
-15-
37
3
17
40
8
38
39
18
7
16
4
12
6
9
10
- 1 -

FUEL INJECTION VALVE

PRIOR ART

The invention is based on a fuel injection valve for a vehicle. In a fuel injection valve of this kind, which has been disclosed by GB 1 320 057, the actuating part of the valve member is embodied as being of one piece with this valve member. The valve member of the prior art has a piston as the actuating part. One end face of the piston borders the control pressure chamber, and another end of the piston includes a pressure shoulder which transitions into a smaller diameter part having an end face that forms a sealing face, which controls the injection opening. The pressure shoulder is subjected to the pressure in the pressure chamber, which continuously communicates with the high-pressure fuel reservoir, which in turn continuously communicates with the control pressure chamber by way of a throttle. This control pressure chamber has a second outlet that is controlled by a piezoelectric valve. When the second outlet opens, the pressure in the control pressure chamber decreases to a relief pressure, the relief pressure acts upon the shoulder of the valve member in an opening direction which opens the injection valve.

In a fuel injection valve of this type, there is the disadvantage that a precise metering of the fuel injection quantity over time and the stroke of the fuel injection valve member is not possible. When the injection valve needle opens, it lifts with its sealing face up from the valve seat and at this instant, the high fuel pressure prevailing in the pressure chamber can also act on the sealing face in the opening direction. As a result, the valve member experiences an additional force in the opening direction, which has a serious effect on the dynamic opening behavior of the valve member. The force that acts in the opening direction reaches a limit value by way of the stroke. The progression of force thereby follows an approximately exponential curve. This property impedes the metering of small fuel injection quantities in which a reclosing of the valve member is required before its end position is reached or before the maximal force that acts in the opening direction is reached. A precise metering of fuel injection quantities is primarily impeded in the intermediary stroke region.

ADVANTAGED OF THE INVENTION

With the fuel injection valve according to the invention, it is now possible to better control the opening event of the valve member so that a more precise metering of small fuel injection quantities becomes possible. With the aid of the piston and the hydraulic chamber that is adjoined by the valve member on one end and by the piston one the other end, a stabilizing force is obtained by way of the compensation pressure face on the valve member and this force smooths the opening event of the fuel injection valve member. Immediately upon the first opening movement of the valve member, a pressure builds up in the hydraulic chamber that increases very rapidly to a maximum value, but then remains constant since starting from particular pressure, the position of the piston can change and thus the volume remains constant. In an advantageous improvement of the invention, the piston is equipped with differently sized piston faces so that the initial pressure in the hydraulic chamber is reduced in relation to the reference pressure, wherein if the pressure of the high-pressure fuel source is selected as the reference pressure, a pressure that is smaller by the reduction ratio acts in the closing direction on the compensation pressure face on the valve member. In this manner, an opposing force can be kept essentially constant on the valve member starting from a particular pressure.

Other advantages can be inferred from the following description of an exemplary embodiment.

BRIEF DESCRIPTION OF THE DRAWINGS

The sole FIGURE illustrates a schematic drawing of a full injection valve.

DESCRIPTION

The sole FIGURE schematically represents a fuel injection valve that is supplied with fuel from a high-pressure fuel reservoir 1. A high-pressure fuel pump 3 aspirates fuel from a fuel tank 4 and supplies it at high fuel injection pressure into the high-pressure fuel reservoir. From there, the fuel travels by way of a pressure line 6 into a pressure chamber 7 of the fuel injection valve 8. The pressure chamber 7 is disposed upstream of a fuel injection opening 9, which is adjoined toward the interior, in the direction of the pressure chamber 7, by a valve seat 10 and whose connection between the pressure chamber 7 and the combustion chamber 11 of an affiliated internal combustion engine is controlled by a sealing face 12 that is provided on the end of a valve member 14. The valve member has an actuating part 15 and a needle part 16, which relieves the pressure chamber 7, in a guide bore 17 of the actuating part and has a sealing face 12 on the end. In the current instance, this sealing face is embodied as conical, in accordance with a conical valve seat 10. Between the actuating part 15 and the needle part 16, a pressure shoulder 18 is formed, which is subjected to the pressure in the pressure chamber 7 in such a way that the fuel produces a resultant force that acts in the opening direction of the valve member 14.

The actuating part 15 protrudes into a hydraulic chamber 20 in the housing of the fuel injection valve and has an annular shoulder 21 which constitutes a compensation pressure face. In this connection, the actuating part includes a reduced diameter part 15*a* exends from the hydraulic chamber and is guided in a guide bore 24 that feeds into a control pressure chamber 23. The actuating part 15 includes an end face 26 that is subjected to the pressure in the control pressure chamber 23. The control pressure chamber continuously communicates with the high-pressure fuel reservoir by way of a throttle 28. Furthermore, a relief conduit 29 leads from the control pressure chamber 23 and if need be, a second throttle 30 is disposed in this relief conduit and, the relief conduit can be opened or closed by means of a valve member 31 of an electrically controlled valve 32. If the valve member 31 is opened, then the pressure in the control pressure chamber is reduced to a relief pressure since more fuel flows out by way of the relief line 29 than can flow in by way of the throttle 28. With the reduction of this pressure, hence with the decreasing forces which, due to this pressure, act on the valve member in the closing direction, the hydraulic forces, which act on the valve member in the opening direction by way of the pressure shoulder 18, predominate. This means that the valve member is opened and the injection by way of the injection opening begins. In order to end this injection event, the valve member 31 is brought back in the closing direction, which results in the hat rapidly replenishing fuel brings the control chamber pressure back to the initial value at the level of the fuel pressure in the high-pressure fuel reservoir 1. This high pressure produces a predominant force in the closing direction of the valve member 15 and initiates the closing event.

The surface areas of the end face 26 and the pressure shoulder 18 must be matched to each other so that an opening event or a closing event can be quickly and reliably carried out. In addition, it must be noted that with the lifting of the valve needle from its valve seat 10, an additional surface area is acted on by the high pressure so that increasing forces up to a limit value act on the valve member in the opening direction. The progression of these forces over the stroke of the valve member or over time is non-linear. Consequently, it becomes more difficult to define and evaluate an opening cross section in the intermediary region of the valve needle stroke. Such reduced opening strokes of the valve needle are particularly important when extremely small fuel injection quantities are to be injected. This is required, for example, when in order to control the combustion process by way of the fuel injection valve, pre-injection quantities are to be introduced into the combustion chamber before a main injection. In order to better control the motion of the valve member, according to the invention, the hydraulic chamber 20 is provided with the compensation pressure face 21 on the annular shoulder between the actuating parts 15 and 15*a*. The hydraulic chamber is closed, but can be displaced. To that end, a piston 33 is provided, which is supported so that it can move in a sealed fashion in a bore 34 that feeds into the hydraulic chamber. This piston is embodied as a stepped piston, with a larger diameter part 35 whose first piston face 36 borders the hydraulic chamber 20, and with a smaller diameter part 37 whose second piston face, its end face 38, reaches into a reference pressure chamber 39, which in turn communicates with the high-pressure fuel reservoir 1 by way of a throttle 40. The piston 33 has a stop 41 which limits the movement of the piston in the direction of the hydraulic chamber 20.

If, as already described above, an opening event of the valve member 14 is initiated, i.e. if the valve member 31 is opened and the control pressure chamber 23 is relieved to a relief pressure, then the valve member will begin to move in the opening direction. In this connection, however, the larger diameter actuating part 15 plunges further into the hydraulic chamber 20 and displaces fuel with its end face 21. This displacement initially produces a pressure increase in this hydraulic chamber due to the rigidity of the hydraulic volume and the elastic properties of the hydraulic medium contained in it. In the present case, this medium is fuel that is also present in the reference pressure chamber 29. Because of the piston 33, in the initial position, the hydraulic chamber is prestressed at a pressure that results from the ratio of the first and second piston faces 36 and 38, which are subjected to pressure. Due to the mobility of the piston, the pressure in the hydraulic pressure chamber can be kept constant, in fact at a pressure that is reduced in relation to the pressure in the reference pressure chamber or in the high-pressure fuel reservoir 1. In connection with the compensation pressure face, this pressure represents an additional loading of the valve:member 14 in the closing direction, which remains essentially constant and consequently as a constant factor, determines the opening characteristic curve of the valve member in a quite significant manner. With the beginning of the opening stroke of the valve member 14, the volume in the hydraulic chamber 20 is prestressed, but is then kept constant because of the mobility of the piston 32. In addition to being determined by the piston surface area 21, the increase of the initial stress over the stroke is also significantly determined by the volume of the hydraulic chamber 20. Depending on the pressure level in the high-pressure fuel reservoir, a corrective force can be introduced counter to the opening stroke of the fuel injection valve member 14. The throttle 40 also plays a role in which the rigidity of the hydraulic column of the hydraulic chamber 20 and the reacting force on the valve member 14 can additionally be adjusted. In particular, a dynamic behavior can be corrected with this throttle in order to influence a nonlinear force increase of the forces that act on the valve member in the opening direction.

With a fuel injection valve of this kind, extremely small fuel injection quantities can be more precisely injected.

What is claimed is:

1. A fuel injection valve comprising a valve member (14) that opens inward counter to an outflow direction of a fuel, said valve member has a sealing face (12) that mates with a valve seat (10), said valve controls an injection opening (9) which connects with a pressure chamber (7) situated upstream of said valve seat (10) said pressure chamber continuously communicates with a high-pressure fuel source (1) and is bordered by a pressure shoulder (18) on a first end of an enlarged diameter portion (15) of the valve member (14), the pressure shoulder (18) is subjected to a pressure in the pressure chamber (7) resulting in an opening force that acts on the pressure shoulder of the valve member (14), the valve member (14) has an actuating part (15*a*) that has a pressure face (26) on a second end of said valve member which is subjected to a control pressure in a control pressure chamber (23), said control pressure produces a closing force that acts on the pressure face (26) on the second end of the valve member (14) in a closing direction counter to the opening force, further comprising a pressure control means for controlling the pressure in said control pressure chamber (23) between a working pressure and a relief pressure, the valve member has a compensation pressure face (21) opposite to the pressure shoulder (18) and borders a closed hydraulic chamber (20) on one end, another end of the hydraulic chamber (20) is bordered by a first piston face (36) of a piston (33), the piston (33) has a second piston face (38) which is disposed remote from the first piston face (36) and is acted on by a constant reference pressure.

2. A fuel injection system comprising:

a high-pressure fuel source (1);

an injection opening (9);

a valve seat (10) on said injection opening;

a pressure chamber (7) situated upstream of the valve seat with respect to a flow of fuel in which said pressure chamber continuously communicate with said high pressure source;

a control pressure chamber (23);

a valve member (14) that moves in opening and closing directions, said valve member having a sealing face (12) that mates with said valve seat (10);

said valve member (14) having a pressure shoulder (18) formed by a portion of the valve member which is enlarged from a rest of the valve member, the pressure shoulder (18) being subjected to a pressure in the pressure chamber (7), the pressure against the pressure shoulder resulting in a first opening force that acts on the valve member (14), the valve member (14) also having an actuating part (15*a*) that includes an end face (26) which is positioned in said control pressure chamber so as to be subjected to a pressure from said control pressure chamber (23), the pressure from said control pressure chamber produces a first closing force that acts on the valve member (14) in a closing direction counter to the opening force;

the high pressure fuel source connected to said control pressure chamber for supplying the control pressure chamber with fuel under pressure and for controlling the pressure in said control pressure chamber between a working pressure and a relief pressure, such that when the pressure in said control pressure chamber (23) is controlled to be at the relief pressure, the first closing force that is produced by the relief pressure acting on the end face (26) is smaller than the first opening force that acts in the opening direction of the valve member (14);

a hydraulic chamber (20);

control means for providing a constant reference pressure to said hydraulic chamber;

the valve member having a compensation pressure face (21) which extends into said hydraulic chamber (20), said compensation pressure face is acted on by the constant reference pressure in said hydraulic chamber (20) to provide a second closing force to the valve member which adds to the first closing force which closing forces function to close the valve member.

3. A fuel injection system comprising:

a high-pressure fuel source (1);

a valve seat (10) having an injection opening (9);

a pressure chamber (7) situated upstream of the valve seat with respect to the flow of fuel;

a control pressure chamber (23);

a valve member (14) that moves in opening and closing directions, said valve member having a sealing face (12) that mates with said valve seat (10) such as to close the injection opening (9); said injection opening (9) being connectable to said pressure chamber (7), said pressure chamber continuously communicates with said high-pressure fuel source (1);

said valve member (14) having one diameter for at least a portion of its length and a pressure shoulder (18) formed by a diameter of the valve member which is enlarged from said one diameter, the pressure shoulder (18) being subjected to a pressure in the pressure chamber (7), resulting in a first opening force that acts on the valve member (14), the valve member (14) also having an actuating part (15*a*) that has an end face (26) which is positioned so as to be subjected to a pressure in said control pressure chamber (23) which produces a first closing force that acts on the valve member (14) in a closing direction counter to the opening force;

pressure control means for controlling the pressure in said control pressure chamber between a working pressure and a relief pressure, such that when the pressure in said control pressure chamber (23) is controlled to be at the relief pressure, the first closing force that is produced by the relief pressure acting on the end face (26) is smaller than the opening force that acts in the opening direction of the valve member (14);

a hydraulic chamber (20);

a piston (33) having a first piston face (36) subjected to a fuel pressure in said hydraulic chamber (20);

control means for providing a constant reference pressure in a reference pressure chamber (39);

the valve member (14) having a compensation pressure face (21) opposite to the pressure shoulder (18), said compensation pressure face borders said hydraulic chamber (20) at one portion of said hydraulic chamber (20), another portion of the hydraulic chamber (20) being bordered by said first piston face (36) of piston (33), the piston (33) having a second piston face (38) which is disposed remote from the first piston face (36) and is acted on by the constant reference pressure in the reference pressure chamber (39).

4. The fuel injection system according to claim 3, in which the second piston face (38) is smaller than the first piston face (36) and pressure of the high-pressure fuel source is used as the reference pressure.

5. The fuel injection system according to claim 3, wherein said compensation pressure face (21) is acted on by the pressure in the hydraulic chamber (20), and thus creates a second closing force on the valve member, and a portion of the sealing face (12) that is positioned within the pressure chamber (7) generates a second opening force on the valve member which acts in the opening direction.

6. The fuel injection system according to claim 5, in which the compensation pressure face (21) is sized so that when the relief pressure is communicated to the control pressure chamber, the sum of the closing forces is less than the sum of the opening forces.

7. The fuel injection system according to claim 3, in which the pressure control means for controlling the pressure in the control pressure chamber includes an electrically controlled control valve (32).

8. The fuel injection system according to claim 7, in which the control pressure chamber (23) communicates continuously with the high-pressure fuel source (1) by way of a first throttle (28) so that the working pressure is the same as pressure from the high-pressure fuel source, and the electrically controlled control valve that controls the pressure in the control pressure chamber (23) functions to relieve pressure in the control pressure chamber from the working pressure to the relief pressure in order to initiate injection through the injection opening.

9. The fuel injection system according to claim 8, in which the electrically controlled control valve connects to the control pressure chamber (23) by way of a second throttle (30) in a conduit (29).

10. The fuel injection system according to claim 3, in which the piston (33) travels toward and away from the hydraulic chamber (20) along a path and the travel of the piston in the direction toward the hydraulic chamber is limited by a stop (41).

11. The fuel injection system according to claim 4, in which the pressure control means for controlling the pressure in the control pressure chamber includes an electrically controlled control valve (32).

12. The fuel injection system according to claim 6, in which the pressure control means for controlling the pressure in the control pressure chamber includes an electrically controlled control valve (32).

13. The fuel injection system according to claim 5, in which the pressure control means for controlling the pressure in the control pressure chamber includes an electrically controlled control valve (32).

14. The fuel injection system according to claim 11, in which the control pressure chamber (23) communicates continuously with the high-pressure fuel source (1) by way of a first throttle (28) so that the working pressure is the same as pressure from the high-pressure fuel source, and the electrically controlled control valve that controls the pressure in the control pressure chamber (23) functions to relieve pressure in the control pressure chamber from the working pressure to the relief pressure in order to initiate injection through the injection opening.

15. The fuel injection system according to claim 12, in which the control pressure chamber (23) communicates continuously with the high-pressure fuel source (1) by way of a first throttle (28) so that the working pressure is the same as pressure from the high-pressure fuel source, and the electrically controlled control valve that controls the pressure in the control pressure chamber (23) functions to relieve pressure in the control pressure chamber from the working pressure to the relief pressure in order to initiate injection through the injection opening.

16. The fuel injection system according to claim 13, in which the electrically controlled control valve connects to the control pressure chamber (23) by way of a second throttle (30) in a conduit (29).

17. The fuel injection system according to claim 14, in which the electrically controlled control valve connects to the control pressure chamber (23) by way of a second throttle (30) in a conduit (29).

18. The fuel injection system according to claim 15, in which the electrically controlled control valve connects to the control pressure chamber (23) by way of a second throttle (30) in a conduit (29).

19. The fuel injection system according to claim 4, in which the piston (33) travels toward and away from the hydraulic chamber (20) along a path and the travel of the piston (33) in the direction toward the hydraulic chamber is limited by a stop (41).

* * * * *